United States Patent [19]

Fukuda et al.

[11] Patent Number: 4,802,632

[45] Date of Patent: Feb. 7, 1989

[54] METHOD AND APPARATUS FOR TREATING END PORTION OF ROLL PAPER

[75] Inventors: Akira Fukuda, Osaka; Itsuro Masuda, Higashiosaka, both of Japan

[73] Assignee: Hamada Printing Press Mfg. Co., Ltd., Osaka, Japan

[21] Appl. No.: 163,335

[22] Filed: Mar. 2, 1988

[30] Foreign Application Priority Data

Nov. 12, 1987 [JP] Japan ..... 62-287789

[51] Int. Cl.[4] ..... B65H 19/18

[52] U.S. Cl. ..... 242/58.5; 242/58.1; 156/504

[58] Field of Search ..... 242/58.1, 58.5, 56 R; 156/502, 504, 505

[56] References Cited

U.S. PATENT DOCUMENTS

| | | | |
|---|---|---|---|
| Re. 29,365 | 8/1977 | Butler, Jr. | 156/504 X |
| 3,780,960 | 12/1973 | Tokuno et al. | 242/58.1 |
| 3,841,944 | 10/1974 | Harris | 242/58.1 X |
| 3,920,502 | 11/1975 | Tokuno | 156/504 |
| 4,170,506 | 10/1979 | Marschke | 242/58.5 X |
| 4,705,226 | 11/1987 | Goetz | 242/56 R |

FOREIGN PATENT DOCUMENTS

| | | |
|---|---|---|
| 61-12561 | 1/1986 | Japan . |
| 62-88758 | 4/1987 | Japan . |

*Primary Examiner*—Stuart S. Levy
*Assistant Examiner*—Steven M. DuBois
*Attorney, Agent, or Firm*—Armstrong, Nikaido Marmelstein & Kubovcik

[57] ABSTRACT

A device and method for treating the end portion of a paper from a paper roll mounted on a paper feed unit of a paper processer. The device arranged adjacent the paper roll is moved toward the paper roll until a presser roller mounted on the device is pressed against it. A cutter assembly facing the paper roll is pushed out so that its cutter will come into contact with the periphery of the paper roll. The cutter is then slid transversely from one end of the paper roll to the other to cut several turns of paper from the paper roll as broke. The broke is rolled out to be fed downwardly over a suction body through a pair of nip rollers and taken up by a take-up mechanism. Another cutter assembly is pushed forward into contact with the central part of the paper end rolled out together with the broke and moved widthwise to make a center cut in the paper end. A cavity forming device is then pressed against the paper end right under the center cut to form a square cavity there. A tab sticking device carrying a tab is pressed against the paper end just over the cavity to stick the upper part of the tab thereon. Two knives for V-cutting arranged at both sides of the paper end are moved laterally toward its center, while rewinding the paper roll, to make a V-cut extending obliquely from both sides toward the cavity. Adhesive is applied to the paper end along the cut edge. The paper end is rewound on the paper roll. The tab adhered to the paper end is then pressed by the presser roller against the surface of the paper roll to be stuck thereto. The broke is then discharged from the take-up mechanism.

5 Claims, 7 Drawing Sheets

METHOD AND APPARATUS FOR TREATING END PORTION OF ROLL PAPER

The present invention relates to a method and apparatus for treating (for splicing) the end portion of roll paper set on a paper feed unit of a paper processor such as a rotary press.

It is usually necessary to attach a tab to the tail end of roll paper mounted on a paper feed unit of a rotary press to prevent an inadvertent rewinding of the paper. Such a roll paper with a tab cannot be spliced automatically. In order to enable the roll paper to be spliced automatically, it has been customary to cut the tail end of the roll paper in an inverted triangular shape in such a manner that the tab will be at the apex of the triangle and to apply adhesive to the paper along the cut edge.

A device for automatically subjecting roll paper to such a pre-treatment is disclosed e.g. in the Japanese Unexamined Patent Publication No. 61-12561. The device for pre-treatment is disposed along the path of roll paper being sent from a storage space to a paper feed unit of a rotary press, thus taking a comparatively large space. Further, the device itself is rather expensive. Thus it is difficult for a small newspaper company having only a small number of rotary presses to purchase such a costly device. Also, this device has many other problems, for example, it tends to damage the roll paper to be treated being carried to the paper feed unit of the rotary press.

It is an object of the present invention to provide a method and device for treating the end portion of roll paper which obviate the abovesaid shortcomings and in which such a pretreatment for splicing can be carried out automatically while the machine is running. The roll paper taken out of a storage space has only to be mounted on a paper feeder of a rotary press.

In accordance with the present invention, there is provided a device for treating the end portion of a paper roll mounted on a paper feed unit of a paper processor and located at a splicing position, the device comprising a driving means adapted to be brought into contact with the paper roll to rotate it, a support frame movable toward and away from the paper roll, a presser roller rotatably mounted on the support frame and adapted to be rotated by contact with the paper roll, a cutter means disposed below the presser roller for transversely cutting a plurality of turns of paper on the paper roll as broke with a cutter movable radially and axially of the paper roll, a suction conveyor means provided below the cutter means and including a suction box elongated transversely of the paper roll, a belt roller and a plurality of perforated belts passed around the suction box and the belt roller so as to extend parallel to one another, the suction box being formed with suction openings at the side behind the paper roll so that they will be aligned with the perforations formed in the belts, nip rollers for holding the broke fed downwardly from the suction conveyor means, a cavity forming means for forming a cavity in the end portion of the paper roll fed together with the broke into between the suction conveyor means and the nip rollers, and a tab sticking means for sticking the upper part of a tab on the paper end at a portion right over the cavity formed by the cavity forming means.

From another aspect, the present invention consists in a method for treating the end portion of a paper roll mounted on a paper feed unit of a paper processor and located at a splicing position, the method comprising the steps of cutting a plurality of rolls of paper of the paper roll in its axial direction as broke, rotating the paper roll in such a direction as to roll out the broke and the end of the paper roll, forming a cavity in the transverse center of the paper end stretched taut after being rolled out, sticking the upper part of a tab on the paper end right over the cavity, moving a pair of cutters disposed at both sides of the paper roll toward its transverse center while rotating the roll paper in a rewinding direction whereby cutting the paper end obliquely in such a manner that the oblique cut lines will converge toward the cavity, applying adhesive to the paper end along the cut edge, rewinding the paper end onto the paper roll so that the tab will be adhered at its lower part to the paper roll by a presser roller kept in contact with the paper roll.

According to the present invention, roll paper mounted on a paper feed unit of a paper processing machine can be (automatically pre-treated for splicing while keeping the machine running.

Other features and objects of the present invention will become apparent from the following description taken with reference to the accompanying drawings, in which.

Figure 1:
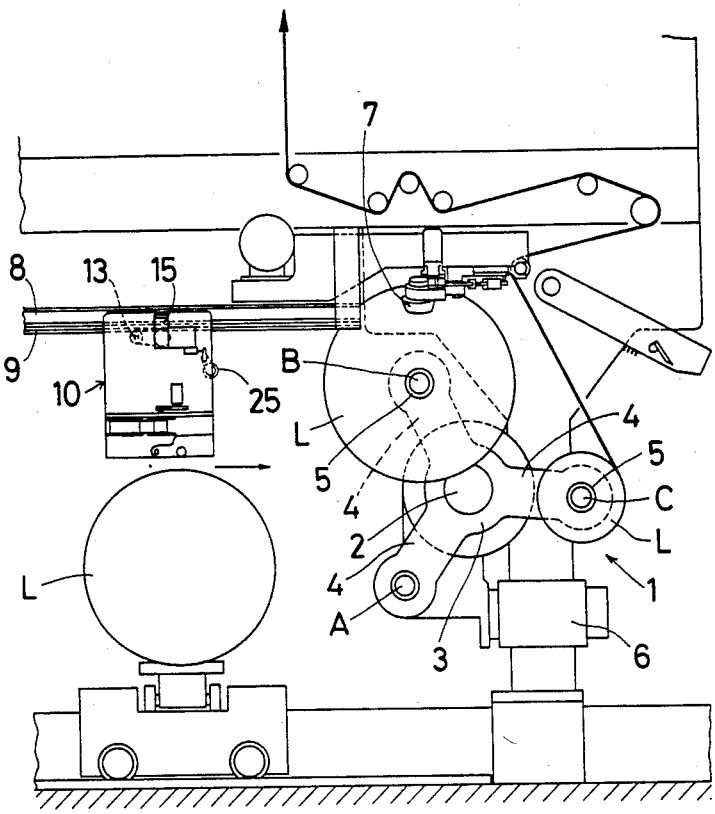
FIG. 1 is a front view of one embodiment of the paper end treatment device for carrying out the method of the present invention.

Now referring to FIG. 1, a paper feeder 1 of a rotary press has a rotary shaft 2 having a pair of roll holders 3 fixedly mounted on both ends thereof. The roll holder 3 at the other end is not shown in FIG. 1. Each holder 3 has three arms 4 radially extending at angular spacings of 120 degrees. Each arm 4 is provided at its head with a bearing 5 for rotatably supporting a paper roll L. The paper roll L is adapted to be braked by a braking device (not shown). The rotary shaft 2 is intermittently rotated by a driving unit 6. The rotary shaft is adapted to stop at positions where the paper roll comes at roll setting position A, splicing position B and paper feed position C. The paper roll between the arms 4 at the roll setting position A are moved to the splicing position B and then to the paper feed position C.

Around the paper roll L at the splicing position B, there is provided a driving mechanism for rotating the paper roll. In the preferred embodiment, the driving mechanism comprises driving rollers 7 adapted to alternately come into contact with and move away from the end faces of the paper roll L. To rotate the paper roll L, the driving rollers 7 are rotated after being brought into contact with the roll L.

A pair of horizontal rails 8 extend toward the upper part of one side of the roll paper L located at the paper splicing position B. The rails 8 are provided on their bottom surface with a rack 9.

Figure 2:
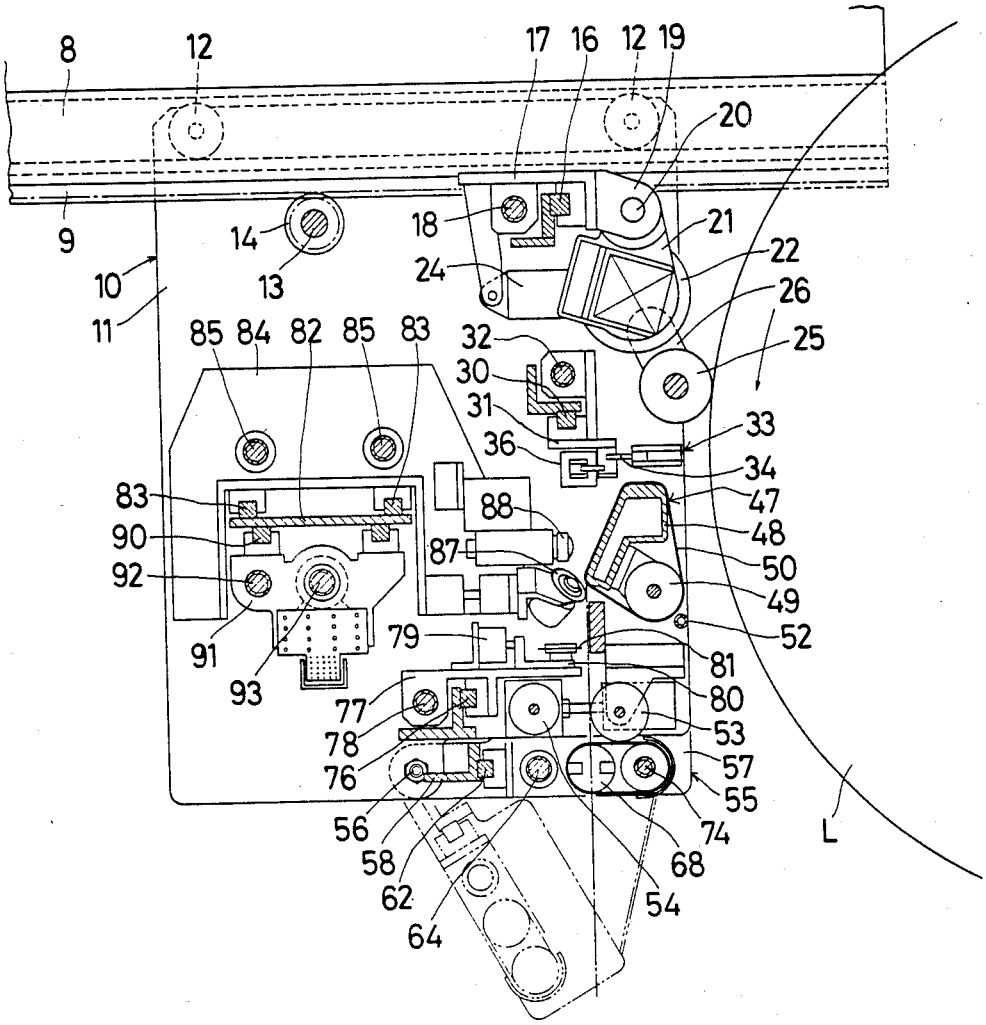
FIG. 2 is an enlarged vertical sectional front view of the same.
Figure 3:
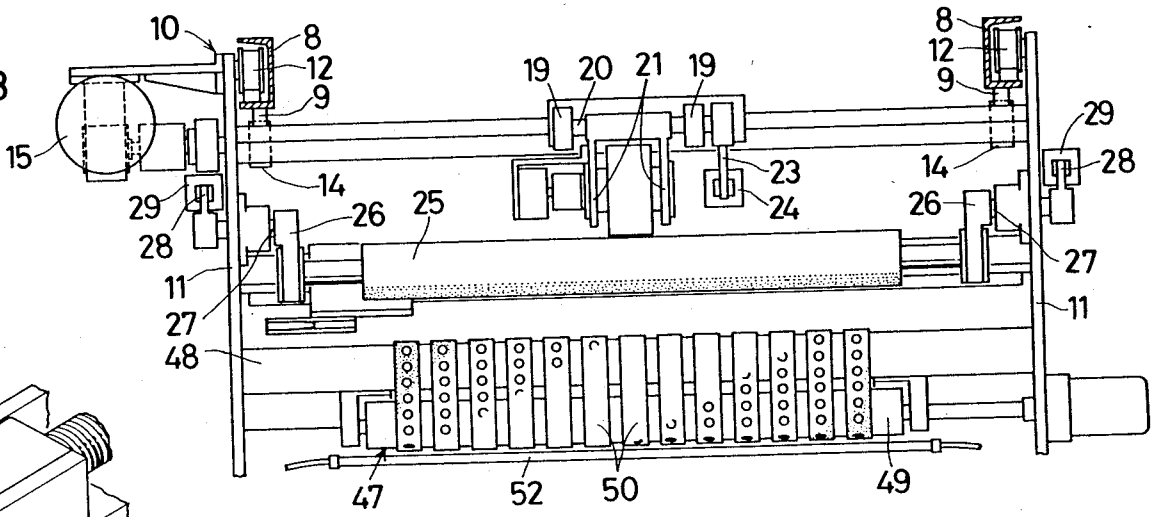
FIG. 3 is a side view of the upper part of FIG. 2.

A support frame 10 suspended from and slidable along the rails 8 includes a pair of side frames 11 as shown in FIGS. 2 and 3. At the upper end of the side frames 11 are provided a pair of wheels 12 supported on the rails 8. A drive shaft 13 extends between the upper parts of the side frames 11. A pair of pinions 14 are mounted on the drive shaft 13 at both ends thereof so as to mesh with the racks 9.

The drive shaft 13 is driven by a motor 15 supported on a support frame 10 as shown in FIG. 1 to move the support frame 10 along the rails 8.

The support frame 10 is illustrated in detail in FIG. 2 in which a first rail 16 extends between the upper parts of the side frames 11. A first carriage 17 is in threaded engagement with a first threaded shaft 18 disposed in parallel with the first rail 16 so as to be movable along the rail 16 by turning the threaded shaft 18 by a motor not shown.

A pair of supporting plates 19 are mounted on the first carriage 17 at its front end facing the paper roll L. A pin 20 extends between the supporting plates 19. A pair of arms 21 have one end thereof fixed to the pin 20 (FIG. 3) with the other end rotatably supporting a measuring wheel 22. The pin 20 is provided at its one end with a lever 23 as shown in FIG. 3. The lever 23 is pivoted by a cylinder 24 mounted on the first carriage 17. (FIG. 3) Thus, the measuring wheel 22 is pivoted by means of the cylinder 24. When swung toward the paper roll, the wheel 22 partially sticks forwardly out of the support frame 10. The measuring wheel 22 rotates by contact with the paper roll L so as to take the length of paper rolled out.

Below the measuring wheel 22, there is provided a presser roller 25 having its both ends supported by arms 26. Each arm has a pin 27 fixed to the upper end thereof. The pin 27 is in turn supported by each side frame 11. The pin has a lever 28 mounted on its outer end protruding through the side frame 11. A cylinder 29 is supported on the side frame 11 to swing the lever 28.

The presser roller 25 is thus pivoted by the cylinders 29 about the pins 27. When pivoted toward the paper roll L, it partially protrudes forwardly out of the side frame 11. When the support frame 10 is advanced toward the paper roll L until the presser roller 25 comes into contact with the roll L, the roller 25 is pushed by the roll L and swings backwardly to actuate during its backward stroke a support frame stop switch, not shown.

Below the first rail 16, a second rail 30 extends in parallel with the first rail as shown in FIG. 2. A second carriage 31 is in threaded engagement with a second threaded shaft 32 extending in parallel with the second rail 30 so as to be movable along the second rail 30. The second carriage 31 is moved along the second rail 30 by turning the second threaded shaft 32 by a motor not shown.

The second carriage 31 has a cutter assembly 33 secured thereto to cut several layers of paper on the top surface of the roll L (this portion of the roll paper is hereinafter referred to as broke) in the direction of width of the roll.

Figure 5:
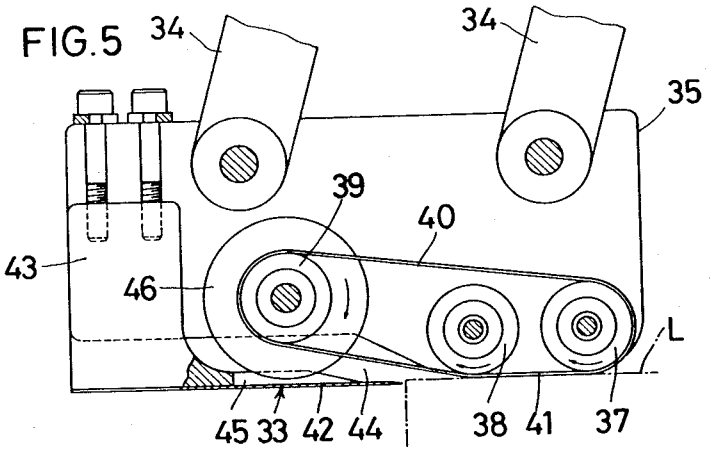
FIG. 5 is a plan view of the cutter support frame of the same.
Figure 4:
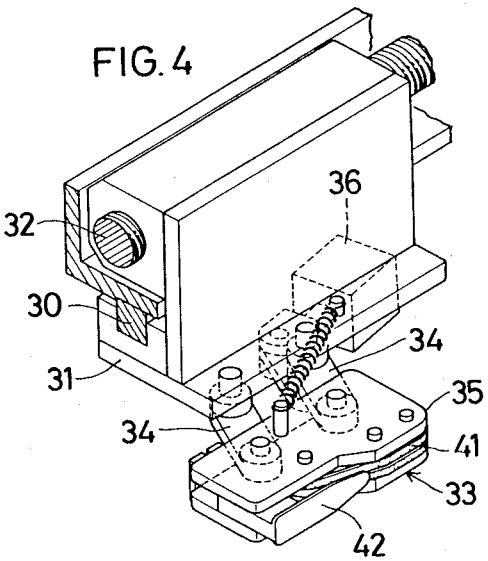
FIG. 4 is a perspective view of the broke cutter assembly of the same.

As shown in FIGS. 4 and 5, the cutter assembly 33 has a cutter support frame 35 secured to one end of a pair of parallel arms 34 having their other end secured to the bottom of the second carriage 31. Also mounted on the bottom of the second carriage 31 is a cylinder 36 for pivoting one of the arms 34. By actuating the clyinder 36, the cutter support frame 35 is moved toward and away from the outer cylindrical surface of the paper roll L. On the cutter support frame 35 are rotatably mounted a head pulley 37, a guide pulley 38 and a tail pulley 39. An endless belt 40 is mounted around the pulleys 37, 38 and 39. A straight portion 41 of the belt 40 between the head pulley 37 and the guide pulley 38 is disposed so as to be ahead of the surface of the cutter support frame 35 facing the paper roll L.

Behind the straight portion 41 is provided a fork 42 having a tapered sharp tip with its front surface arranged ahead of the straight portion 41. The fork 42 is provided on its rear end with a projection 43 supported by the support frame 35. A paper passageway 44 is defined between the fork 42 and the front end of the cutter support frame 35.

The fork 42 is formed in its back with a groove 45 in which is received part of a round cutter 46 unrotatably mounted on a shaft of the tail pulley 39.

In operation, with the presser roller 25 in contact with the outer peripheral surface of the paper roll L, the cylinder 36 is actuated to advance the cutter support frame 35 until the straight portion 41 of the belt 40 comes into contact with the peripheral surface of the paper roll L. Now, the fork 42 has its tip opposite to and near one end face of tht roll L. The second threaded shaft 32 is then turned to slide the second carriage 31 along the second rail 30. This causes the fork 42 to stick into the paper roll L through its end face. At the same time the belt 40 is turned by the contact between the straight portion 41 and the paper roll L to turn the cutter 46. Thus several turns of paper scooped up by the fork 42 are cut off widthwise as the broke by the cutter 46.

Figure 6:
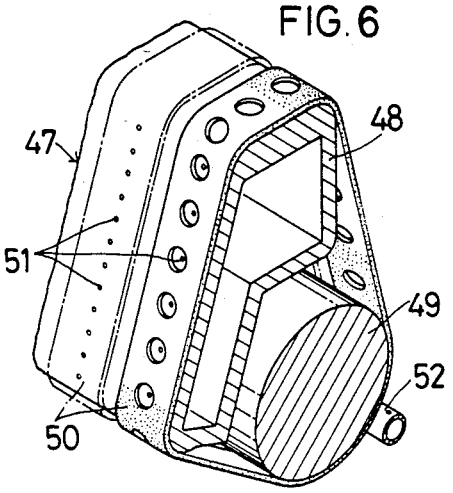
FIG. 6 is a perspective view of a part of the suction conveyor assembly of the same.

As shown in FIG. 2, under the cutter assembly 33, there is provided a suction conveyor 47 for discharging downwardly the broke unrolled out of the outer periphery of the roll L. As shown in FIGS. 2 and 6, the suction conveyor 47 comprises a suction box 48 extending between the pair of side frames 11, a belt roller 49 disposed under the box 48 and rotated by a motor, and a plurality of perforated belts stretched in parallel to one another around the belt roller 49 and the suction box 48. The suction box 48 is formed in its back facing the paper roll L with suction openings 51 so that they will be aligned with the perforations of the belts 50.

When the broke is brought down over the back of the suction box 48, it is attracted onto the belts 50 owing to the attraction force of the suction assembly and sent downwardly with the belt 50. In order to send the broke rolled out of the roll L to the back side of the suction box 48, an air blow pipe 52 provided at the front lower side of the belt roller 49 blows air at the contact portion between the presser roller 25 and the roll paper L.

Below the suction conveyor 47, a pair of nip rollers 53 and 54 are provided to hold the broke fed down along the back of the suction box 48 and feed them further downwardly. One of the nip rollers 53 is fixed in a stationary position and driven by a motor (not shown). The other nip roller 54 is mounted so as to be moved by a cylinder or the like toward and away from the nip roller 53.

Figure 7:
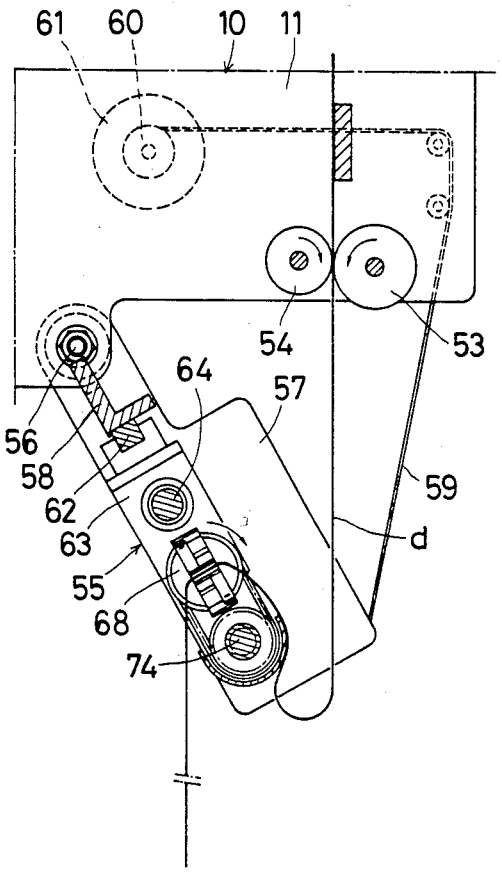
FIG. 7 is a vertical sectional front view of the take-up up assembly of the same.
Figure 8:
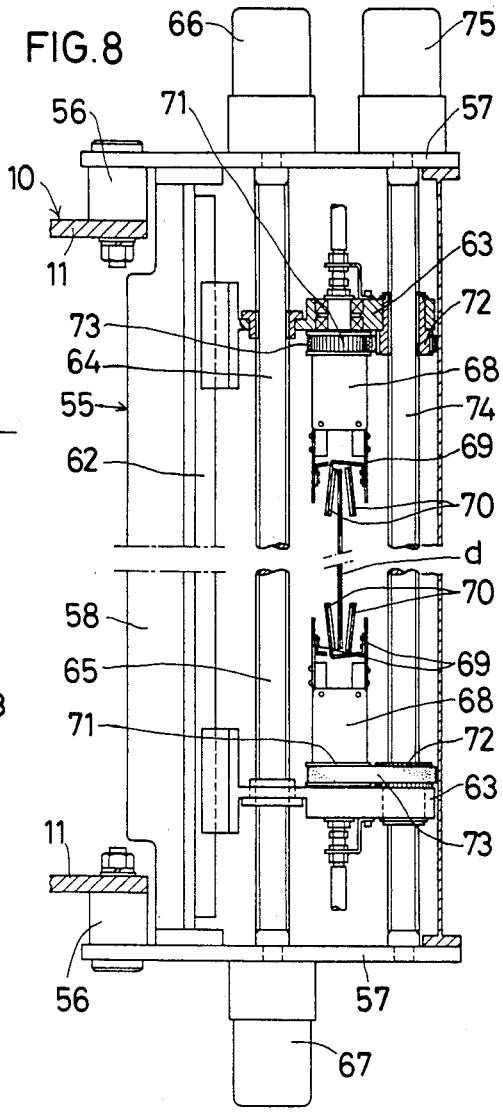
FIG. 8 is a plan view of FIG. 7.

Below the nip rollers 53 and 54, there is provided a take-up mechanism 55 for the broke fed from the nip rollers. As shown in FIGS. 7 and 8, the take-up mechanism 55 comprises a pair of arms 57 pivotally supported on pins 56 fixed to the lower part of the side frames 11 of the support frame 10, a stay 58 bridging the arms 57, wires 59 connected to the end of the arms 57, a take-up drum 60 for taking up the wires 59, and a motor 61 for the drum 60. The arms 57 are pivotable by rotating the drum 60.

A rail 62 is mounted on the stay 58. A pair of chuck supporting plates 63 are mounted so as to be slidable along the rail 62. One of the chuck supporting plates 63 is in threaded engagement with a threaded shaft 64 and the other one with a threaded shaft 65. The pair of threaded shafts 64 and 65 are coaxially arranged and driven, independently of each other, by motors 66 and 67 supported on the arms 57, respectively. An air chuck 68 is rotatably mounted on each chuck supporting plate 63.

Each air chuck 68 is provided with a pair of jaws 69 movable toward and away frome each other. Each jaw has an L-shape gripper plate 70 secured to its inner surface so that it will face the jaw 69 at the opposite side. With this arrangement, when the jaws 69 are spread open, the gripper plates 70 are moved toward each other. In operation, after bringing each side edge of the broke in between the respective pair of gripper plate, the jaws 69 are spread open to close the gripper plates and hold the broke therebetween.

A gear 71 is fixed to each chuck 68. A timing belt 73 extends around the gear 71 and a driving gear 72 supported on the chuck supporting plate 63 at its end.

The driving gears 72 are axially slidably but unrotatably mounted on a spline shaft 74 passed between the ends of the pair of arms 57. A motor 75 connected to the spline shaft 74 is actuated to rotate the spline shaft and thus the air chucks 68.

With each pair of gripper plates 70 holding the respective side edge of the broke, the spline shaft 74 is turned to turn the air chucks 68 and take up the broke around the gripper plates 70.

Behind the nip rollers 53 and 54, as shown in FIG. 2, a third rail 76 extends between the side frames 11.

A third carriage 77 is in threaded engagement with a third threaded shaft 78 extending parallel with the third rail 76 so as to be slidable therealong. The third carriage 77 is moved along the third rail by turning the third threaded shaft 78 by a motor (not shown).

Figure 9:
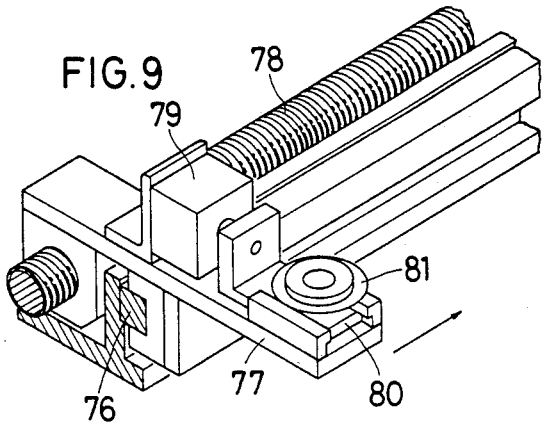
FIG. 9 is a perspective view of a part of the third mobile deck of the same.

As shown in FIG. 9, the third carriage 77 has a cylinder 79 and a cutter support 80 mounted thereon so as to be moved by the cylinder 79. The cutter support 80 carries a round cutter 81 and is movable with respect to the broke which extends from the back side of the suction box 48 to the nip rollers 53 and 54.

The cutter 81 serves to make a widthwise center cut of a predetermined length in the paper pulled out of the roll L together with the broke. To form such a cut, the third carriage 77 is slid along the rail 76 with the cutter support 80 moved forward.

Figure 10:
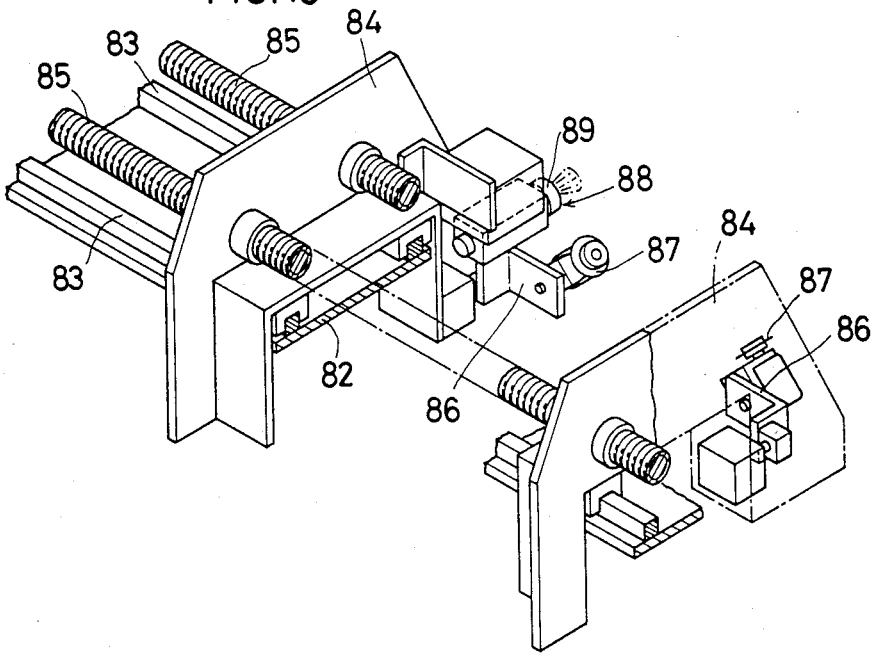
FIG. 10 is a perspective view of a part of the fourth mobile deck of the same.

At the rear between the second rail 30 and the third rail 76, a rail supporting plate 82 is provided with both ends thereof supported by the side frames 11. On the rail supporting plate 82 is mounted a pair of fourth rails 83 so as to extend between the side frames 11. A pair of fourth carriages 84 are provided so as to be slidable along the fourth rails 83 (FIG. 10).

A pair of fourth threaded shafts 85 pass through the fourth carriage 84 and are rotatably supported on the side frames 11. Two motors (not shown) are employed to independently rotate the threaded shafts 85. Each of the threaded shafts 85 is in threaded engagement with each of the pair of fourth carriages 84. Thus, by turning the fourth threaded shafts 85, the fourth carriages 84 are moved along the fourth rails 83.

Each fourth carriage 84 has a bracket 86 mounted on its one side confronting the roll paper L. A knife 87 for making a V-cut is obliquely secured to the bracket 86. The knives 87 located behind and downwardly of the suction box 48 are brought toward both sides of the end portion of the paper rolled out of the roll L. Then the fourth carriages 84 are moved along the rails toward the center of the paper while at the same time rewinding the paper. This forms a V-cut in the paper at its end.

Over each knife 87 is provided an adhesive applicator 88 for applying adhesive to the paper along its V-cut edge. In the preferred embodiment, the applicator 88 is provided with a nozzle 89. Adhesive is blown out of the nozzle 89 attached to the side of fourth carriage 84. In place of the nozzles 89, applicator heads may be provided so as to be movable toward and contact the paper edge and apply adhesive thereto. Adhesive is applied in a predetermined pattern.

Figure 11:
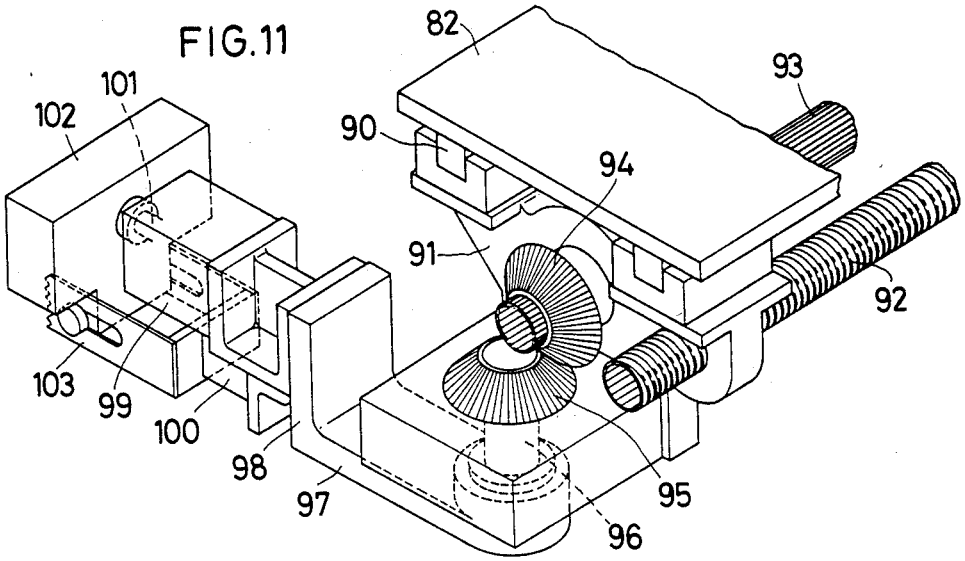
FIG. 11 is a perspective view of a part of the arm support of the same.

As shown in FIGS. 2 and 11, a pair of fifth rails 90 are mounted on the bottom surface of the rail supporting plate 82 so as to extend between the side frames 11. An arm support 91 is threadedly mounted on a fifth threaded shaft 92 bridging the side frames 11 so as to be slidable along the fifth rails 90. The arm support 91 is moved by a motor (not shown) through the fifth threaded shaft 92.

Through the arm support 91 is inserted a spline shaft 93 which has its both ends supported by the side frames 11 and is adapted to be driven by a motor (not shown). The spline shaft 93 has a bevel gear 94 mounted thereon so as to be unrotatable but axially slidable with respect to the spline shaft. The bevel gear 94 is in turn rotatably supported by the arm support 91.

The rotation of the spline shaft 93 is transmitted to an arm support shaft 96 through the bevel gear 94 and another bevel gear 95 meshing with the gear 94.

The arm support shaft 96 is rotatably supported on a bearing fixed to the arm support 91. The arm support shaft 96 has an arm 97 fixed to its bottom end. The arm 97 is provided on its front end with a supporting plate 98 which carries a tab suction cylinder 99 and a cavity forming cylinder 100.

A tab suction plate 102 formed with air suction holes is fixed to a piston rod of the tab suction cylinder 99. To a piston rod of the cavity forming cylinder 100, a U-shaped blade 103 is fixed. The cylinders 99 and 100 are swung through 90 degrees between two positions by rotating the spline shaft 93. In one of the two positions, the tab suction plate 102 and the U-shaped blade 103 confront one of the side frames 11. In the other position, they confront the end of paper L hanging down from the suction box 48.

Figure 12:
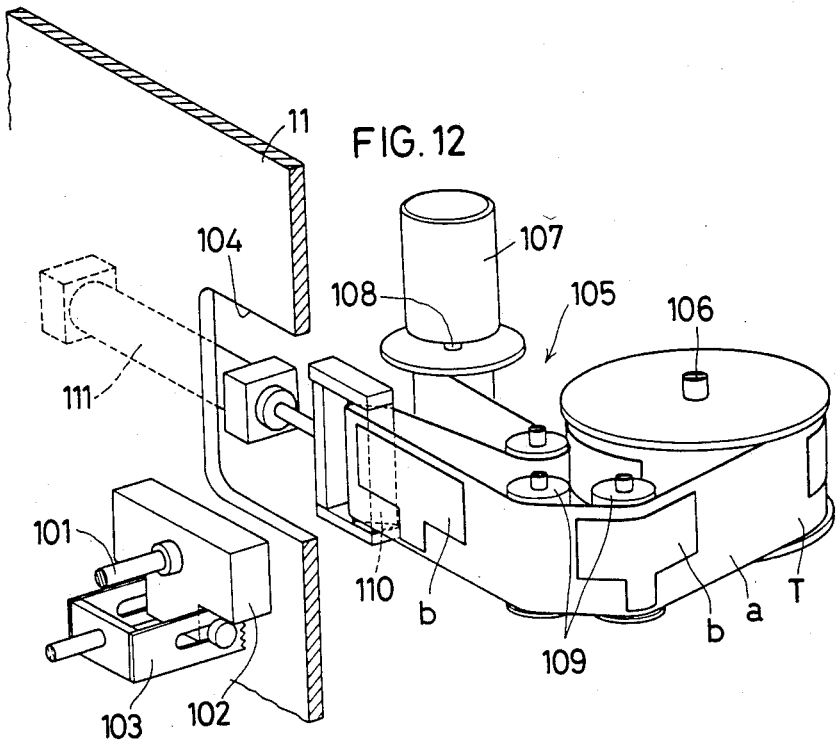
FIG. 12 is a perspective view of the tab feed assembly of the same.

As shown in FIG. 12, the side frame 11 to which the tab suction plate 102 and the blade 103 face is formed with a window 104 large enough for the tab suction plate 102 to pass through. Outside the window 104, there is provided a tab feed assembly 105.

The tab feed assembly 105 comprises a support shaft 106 for supporting a roll of tab tape T, a reel 108 rotated by a motor 107 for taking up the tab tape, and a plurality of guide rollers 109 and a guide 110 for turning the feed direction of the tape T at an acute angle. The guide rollers 109 and the guide 110 are disposed along the path of the tape from the support shaft 106 to the reel 108. The guide 110 is moved by a cylinder 111 in the direction of feed of the tape.

The tab tape T comprises a substrate a having a release coating on one side thereof and tabs b having an adhesive layer on its back and stuck to the substrate on its release coated side at equal spacings. When the reel 108 is taking up the tab tape T, the guide 110 is drawn by the tensile force of the tape in the direction opposite to the feed of the tape so that the tabs b are peeled off the substrate a one by one.

In operation, after the tab suction plate 102 has been brought into contact with and stuck to the tab b positioned immediately before the guide 110, the reel 108 is turned to take up the tab tape T, so that the tab b stuck to the tab suction plate 102 is peeled off the substrate a.

Next, the operation of the entire machine will be discussed below.

The support frame 10 is advanced toward the paper roll L in the paper splicing position B, until the presser roller 25 abuts the paper roll L. By further advancing the support frame 10, the presser roller 25 pivots rearwardly about the pins 27 so as to actuate the stop switch and stop the movement of the support frame 10. In this state, the presser roller 25 and the measuring wheel 22 are kept in contact with the cylindrical surface of the paper roll L.

After the support frame 10 has come to a stop, the cylinder 36 mounted on the second carriage 31 is actuated to push the cutter support frame 35 toward the paper roll L until the straight-line portion 41 of the belt 40 abuts the outer periphery of the paper roll L. Then, the second threaded shaft 32 is turned to shift the cutter support frame 35 along the paper roll L from one end thereof to the other.

Figure 13:
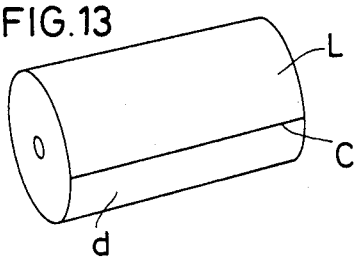
FIG. 13 to 20 are perspective views showing in sequence how the end portion of roll paper is processed.
Figure 14:
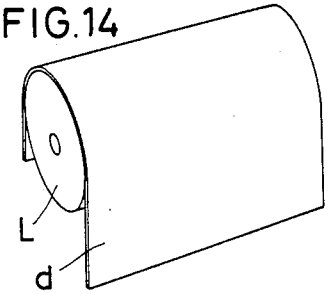

Thus, as shown in FIG. 13, several turns of paper of the roll L is cut off widthwise as broke by the cutter 46. A capital letter C indicates the cut line. After cutting off the broke, the driving rollers 7 are brought into contact with the paper roll L to rotate it in the direction of arrow in FIG. 2. At the same time, air is blown out of the air blow pipe 52.

The broke d rolled out of the roll L is fed out onto the back of the suction conveyor 47. The measuring wheel 22 rotates as the broke is fed downwardly to measure the length of its feed.

The broke d is fed down along the back of the suction box 48 into between the nip rollers 53 and 54 and further sent downwardly past the pair of air chucks 68 of the take-up device 55. When the length of the broke that hangs down from the air chucks 68 reaches a predetermined length, the driving rollers 7 stop.

In this state, the threaded shafts 64 and 65 of the take-up device 55 are turned to bring the air chucks 68 close to the side edges of the broke d until each side edge comes between the pair of gripper plates 70 of each air chuck. The air chucks 68 are actuated to hold the broke d with the gripper plates 70. Next, the driving rollers 7 are rotated again to rotate the paper roll L and roll out the broke, and at the same time the arms 57 of the take-up device 55 pivots downwardly about the pin 56.

Figure 15:
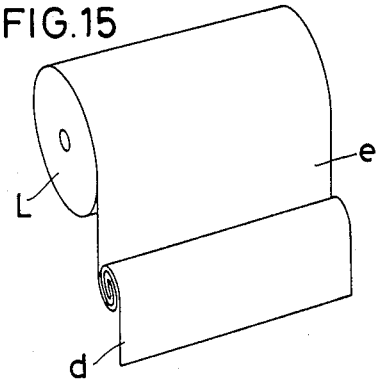

With this downward pivotal movement of the arms 57, the air chucks 68 rotate to wind up the broke therearound. (FIG. 15) When a predetermined amount of broke has been wound, the air chucks 68 and the driving rollers 7 come to a stop.

During the above operation, the third carriage 77 is moved to about the transverse center of the broke by rotating the third threaded shaft 78 and is held in the position. The tab suction plate 102 which has sucked the tabs b supplied from the tab feed assembly 105 is moved by rotating the fifth threaded shaft 92 to such a position to confront the transverse center of the broke.

Figure 16:
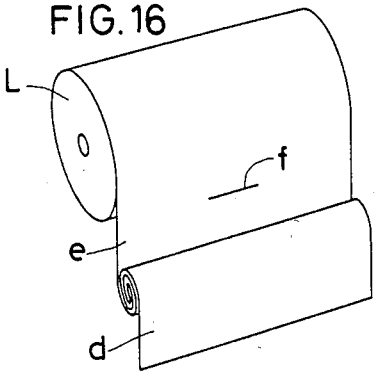

Upon the stop of the driving rollers 7, the cylinder 79 mounted on the third carriage 77 is actuated to move the cutter support 80 forward and stick the cutter 81 into the end e of the paper L rolled out together with the broke. Then the third threaded shaft 78 is rotated to move the cutter support 80 horizontally to make a predetermined length of cut in the end e as shown in FIG. 16. A letter f indicates the cut line. After cutting, the cutter support 80 is retracted and brought back to a standby position by turning the third threaded shaft 78 in the reverse direction.

Figure 17:
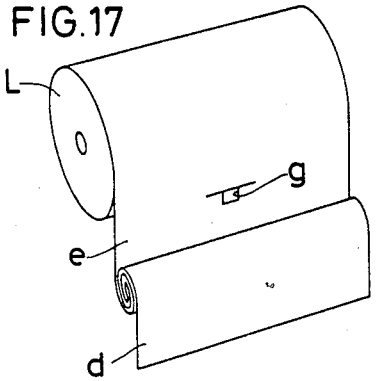
Figure 18:
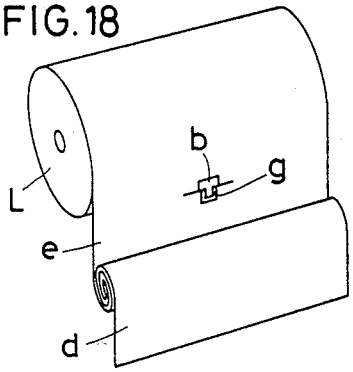

The arm 97 supported by the arm support shaft 96 makes a 90-degree turn with a 90-degree revolution of the spline shaft 93 to bring the U-shaped blade 103 to a position facing the end portion e of the roll paper L. Thereupon, the cavity forming cylinder 100 is actuated to forward the blade 103 and form a cavity g in the end portion e of the roll paper L as shown in FIG. 17. After the formation of the cavity, the blade 103 retracts.

Next, the tab suction cylinder 99 is actuated to advance the tab suction plate 102 so that the tab b carried thereon will be stuck at its upper part on the roll paper right over the cavity g.

After sticking the tab b, the tab suction plate 102 is retracted and brought back to a tab suction position. Also, the suction conveyor assembly 47 is actuated to move the belt 50, while the nip rollers 53 and 54 and the driving rollers 7 are rotated to feed the roll paper L further downwardly until its end portion e reaches a V-cut starting point.

Figure 19:
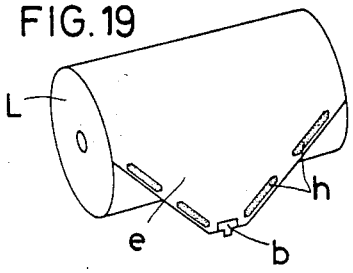

Upon receiving a V-cut start signal, the suction box 48 starts sucking, the belt 50 of the suction conveyor assembly 47 moves in the reverse direction and the driving rollers 7 rotate in the reverse direction to move the paper end e in the rewinding direction. With the rewinding movement of the roll paper, the fourth threaded shafts 85 are rotated to slide the pair of fourth carriages 84 toward each other. As a result, the knives 87 for V-cutting and the nozzles 89 are moved laterally, so that the paper end e is cut obliquely from both side edges toward the cavity g. Adhesive is blown out of the nozzles 89 onto the paper along its cut line in a predetermined pattern as shown in FIG. 19 by a letter h.

Figure 20:
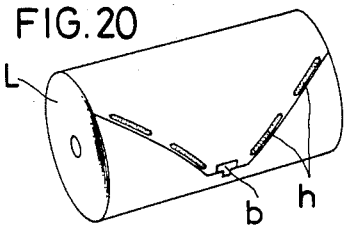

After cutting the end portion e and applying adhesive thereto, the end portion is rewound on the roll paper L. The tab b adhered to the end e of the paper is then pressed by the presser roller 25 against the surface of the roll paper to be stuck thereto as shown in FIG. 20.

The air chucks 68 subsequently start rotating to take up the remainder of the broke. After taking up the broke, the jaw or gripper control plates 69 of the air chucks 68 are closed to open the gripper 70 and then the air chucks move outwardly to drop the rolled broke d.

Upon completion of the above-described operation, all the parts of the machine returns to their original positions.

Generally, a rotary press has its paper feed units disposed in spaced relationship in the direction of feed of roll paper. Accordingly, if every element of the device shown in FIG. 2 is provided in pair so that each pair will be arranged symmetrical with respect to the vertical line bisecting the line connecting the pair of fourth threaded shafts 85 and if such a device is provided movably between adjacent paper feed units, it can serve both the roll papers set in splicing positions on adjacent paper feed units.

In the preferred embodiment, the paper end treatment device according to the present invention was adapted for use with a paper feed unit of a newspaper rotary press. But the method and device of the present invention are applicable to other paper processing machines such as a corrugating machine.

What is claimed is:

1. A device for treating the end portion of a paper roll mounted on a paper feed unit of a paper processor and located at a splicing position, said device comprising a driving means adapted to be brought into contact with said paper roll to rotate it, a support frame movable toward and away from said paper roll, a presser roller rotatably mounted on said support frame and adapted to be rotated by contact with said paper roll, a cutter means disposed below said presser roller for transversely cutting a plurality of turns of paper on said paper roll as broke with a cutter movable radially and axially of said paper roll, a suction conveyor means provided below said cutter means and including a suction box elongated transversely of said paper roll, a belt roller and a plurality of perforated belts passed around said suction box and said belt roller so as to extend parallel to one another, said suction box being formed with suction openings at the side behind said paper roll so that they will be aligned with said perforations formed in said belts, nip rollers for holding said broke fed downwardly from said suction conveyor means, a cavity forming means for forming a cavity in the end portion of said paper roll fed together with said broke into between said suction conveyor means and said nip rollers, and a tab sticking means for sticking the upper part of a tab on said paper end at a portion right over said cavity formed by said cavity forming means.

2. A device for treating the end portion of a paper roll as claimed in claim 1, wherein said cutter means comprises a carriage mounted to be movable axially of said paper roll, a cutter support frame provided to be movable radially of said paper roll, a drive means for moving said cutter support frame toward and away r from said paper roll, said cutter support frame and said drive means being supported by said carriage, a positioning means mounted on said cutter support frame and having a reference plane on the side facing said paper roll, a fork means disposed beside and ahead of said reference plane, said fork means and said cutter support frame defining a paper passageway between the back of said fork means and the front side facing said paper roll of said cutter support frame, and a cutter provided in said paper passageway for cutting paper scooped up by said fork means.

3. A device for treating the end portion of a paper roll as claimed in claim 1, wherein said tab sticking means comprises a tab feed means and a tab carrier means, said tab feed means including a support shaft for rotatably supporting a roll of tab tape, said tab tape comprising a substrate having a release coating on one side thereof and tabs having an adhesive layer on its back and stuck to said substrate on the release coated side at equal spacings, a reel for taking up a web of said substrate of said tab tape, and a tape guide disposed along the path of said tab tape for turning the feed direction of said tab tape at an acute angle, said tape guide being adapted to be drawn by the tensile force applied to said tab tape in such a direction as to allow said tabs to be peeled off said substrate, said tab carrier means including a cylinder having a piston rod and a tab suction means mounted on the head of said piston rod, said tab carrier means being movable between the position for picking up a tab from said paper feed means and the position for sticking said tab on the outer periphery of said paper roll.

4. A device for treating the end portion of a paper roll as claimed in claim 1, further comprising a broke take-up mechanism including a pair of air chucks for winding said broke therearound and discharging it, said each air chuck being provided on the side opposite to each other with a pair of jaws and a pair of gripper plates each fastened to the inner surface of said respective jaws so as to be moved toward each other to grip the side edges of said broke when said pair of jaws are moved away from each other and so as to be moved away from each other to release the hold of said side edges when said pair of jaws are moved toward each other, and driving means for rotating said air chucks synchronously with each other to wind said broke around said jaws and for moving said air chucks toward and away from each other.

5. A method for treating the end portion of a paper roll mounted on a paper feed unit of a paper processor and located at a splicing position, said method comprising the steps of cutting a plurality of rolls of paper of said paper roll in its axial direction as broke, rotating said paper roll in such a direction as to roll out said broke and the end of said paper roll, forming a cavity in the transverse center of said paper end stretched taut after being rolled out, sticking the upper part of a tab on said paper end right over said cavity, moving a pair of cutters disposed at both sides of said paper roll toward its transverse center while rotating said roll paper in a rewinding direction whereby cutting said paper end obliquely in such a manner that the oblique cut lines will converge toward said cavity, applying adhesive to said paper end along said cut edge, rewinding said paper end onto said paper roll so that said tab will be adhered at its lower part to said paper roll by a presser roller kept in contact with said paper roll.

* * * * *